United States Patent [19]

Keener

[11] 4,434,929

[45] Mar. 6, 1984

[54] HAMMER WITH MAGAZINE NAIL FEED

[76] Inventor: Neil F. Keener, P.O. Box 573, Jemez Springs, N. Mex. 87025

[21] Appl. No.: 325,184

[22] Filed: Nov. 27, 1981

Related U.S. Application Data

[63] Continuation-in-part of Ser. No. 221,911, Dec. 31, 1980.

[51] Int. Cl.[3] ..... B25C 1/02; B25C 3/00

[52] U.S. Cl. ..... 227/115; 145/30 R; 145/30 A; 227/147; 227/120

[58] Field of Search ..... 145/30 R, 30 A; 227/120, 113, 114, 115, 116, 117, 147

[56] References Cited

U.S. PATENT DOCUMENTS

| | | | |
|---|---|---|---|
| 970,809 | 9/1910 | Gates | 145/30 R |
| 1,048,535 | 12/1912 | Hoover et al. | 145/30 R |
| 1,609,592 | 12/1926 | Williams | 145/30 R |
| 4,340,101 | 7/1982 | Schär | 227/147 X |

*Primary Examiner*—Paul A. Bell

*Attorney, Agent, or Firm*—Harvey B. Jacobson

[57] ABSTRACT

A generally conventional hammer construction is provided including a nail containing and feeding magazine supported therefrom and extending through the head of the hammer and the adjacent handle portion thereof along a substantially straight path disposed in a plane which contains not only the handle of the hammer but also the transverse head thereof. One end of the magazine exits through the side of the head of the hammer remote from the handle and the other end of the magazine is inclined generally 45° relative to the handle and is spaced outwardly of the side of the hammer handle remote from the nail driving face of the hammerhead. Structure is provided for biasing a row of transverse nails within the magazine toward the one end thereof and the hammerhead is equipped with nail feed and head backing structure operative from the remote end of the hammer handle to longitudinally feed a nail from the magazine to an initial set position with the nail tip extending slightly beyond the nail driving face of the hammerhead and with the remote head end of the nail rigidly backed in order to enable the hammer to be swung toward a workpiece for initial setting of the nail in the workpiece.

14 Claims, 8 Drawing Figures

HAMMER WITH MAGAZINE NAIL FEED

BACKGROUND OF THE INVENTION

This application comprises a continuation-in-part of my co-pending application Ser. No. 221,911, for HAMMER WITH ATTACHED NAIL FEED MAGAZINE, filed Dec. 31, 1980.

The hammer disclosed herein and in the accompanying drawings comprises an improvement over the hammer disclosed in my co-pending U.S. application Ser. No. 221,911, in that the nail feed and nail head backing structure of the instant invention has been greatly simplified over that disclosed in my co-pending application. However, the hammer of the instant invention includes the basic hammer and nail magazine structure of my co-pending application and also the handle free end actuating structure for the nail feed and nail head backing structure carried by the head of the hammer.

BRIEF DESCRIPTION OF THE INVENTION

The hammer of the instant invention has been simplified to include major components thereof including only a nail feeding and nail head backing lever, an actuating bell crank enjoying a pin and slot connection with the nail feeding lever and with the lever and actuating bell crank oscillatably supported from the associated hammerhead. Further, the hammer additionally includes an operating bell crank oscillatably supported from the free end of the hammer handle and a connecting link pivotally connecting the head and handle mounted bell cranks. The pin and slot connection between the nail feeding lever and the actuating bell crank for the nail feeding lever defines structure which enables the nail feeding lever to be positively backed as a result of final movement of the nail feed lever to the full nail feed position and thereby assures that the nail which has been displaced to the feed position may be readily set in a workpiece by the user of the hammer.

The objects of the instant invention include those set forth in my above noted co-pending application and further includes as an important object providing a nail magazine equipped hammer of the type disclosed wherein the nail feed and nail head backing structure includes a minimum number of components and utilizes relatively simple structural features, whereby the nail feeding and nail head backing structure can be inexpensively produced so as to provide a rugged and durable nail feeding and nail head backing mechanism.

This object together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
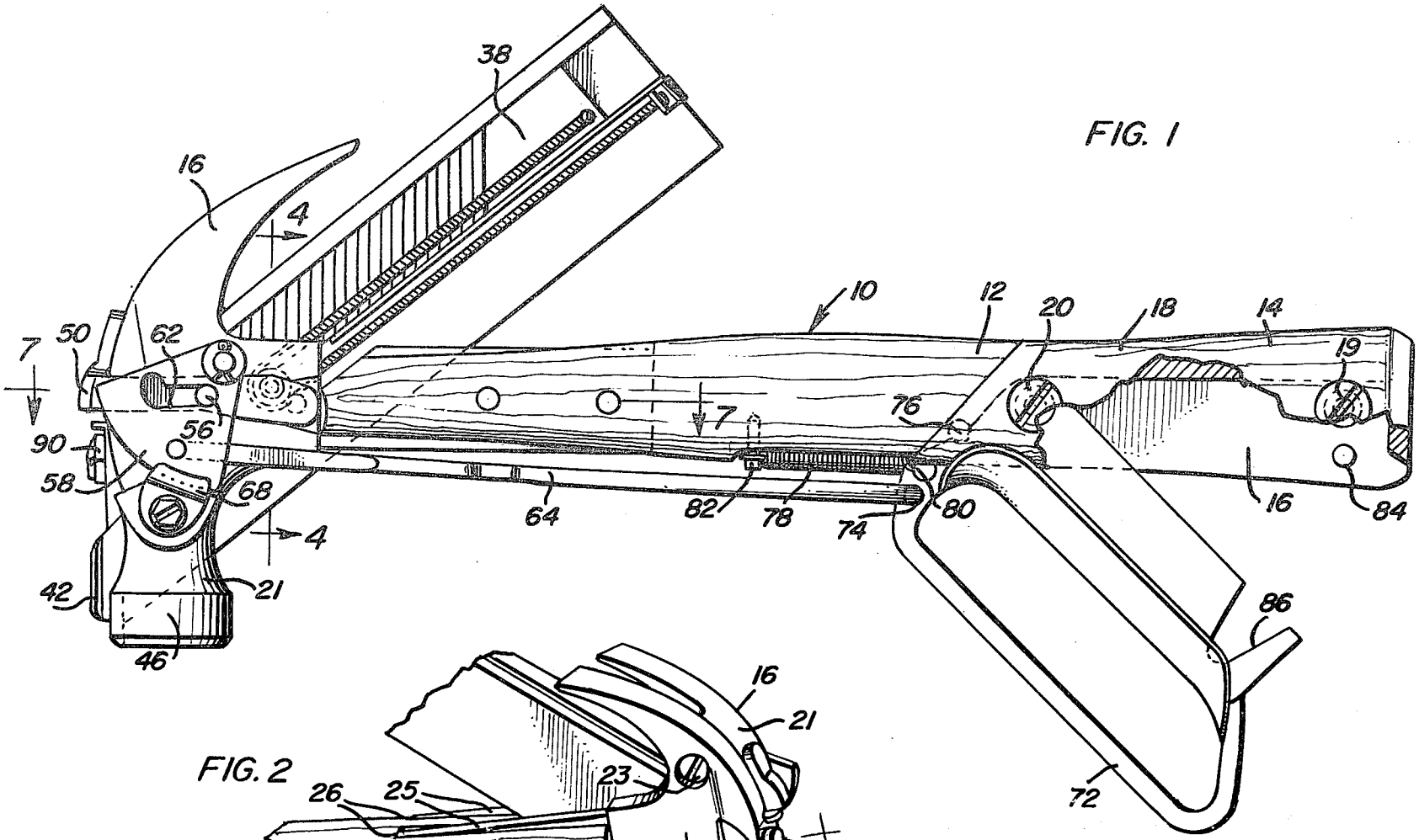
FIG. 1 is a side elevational view of the hammer of the instant invention with a fragmentary portion of the adjacent side of the free end of the handle being broken away and illustrated in vertical section.

Referring now more specifically to the drawings, the numeral 10 generally designates the hammer of the instant invention. The hammer 10 includes an elongated handle 12 defining a handgrip 14 at one end and a claw hammerhead 16 at the other end. The hammer handle 12 includes a recess 16 formed in the handgrip end 14 and includes a removable cover portion 18 for covering the recess 16, the cover portion 18 being removably secured in position through the utilization of suitable fasteners 19 and 20. The hammerhead 16 includes a pair of hammerhead halves 21 and 22 secured together through the utilization of fasteners 23 and 24 and each hammerhead half includes a panel-like tang portion 25. The head end of the handle 14 includes a pair of forwardly opening grooves 26 in which the tangs 25 are secured by suitable transverse pins or fasteners 27, see FIG. 2.

The hammer halves 21 and 22 define an inclined passageway 28 extending therethrough and an elongated narrow nail magazine 32 is secured in the passageway through the utilization of fasteners 33. A plurality of nails 34 are received within the magazine 32 in side-by-side longitudinally graduated positions and each nail 34 includes a head 36 having a notch therein for receiving the upper end of the shank of the next uppermost nail 34. In this manner, the nails 34 are compactly received within the magazine. The magazine 32 includes a spring biased follower 38 yieldingly biasing the nails 34 longitudinally of the magazine toward the discharge end 40 thereof which opens through the central portion of the head 16 between the halves 21 and 22. The opposite sides of the discharge end of the magazine include spring-type nail retaining fingers 42 and the nail striking end 46 of the head 16 includes a groove 49 formed therein in registry with the pointed end of the nail 34 disposed in the "feed" position at the discharge end 40 of the magazine 32 for receiving the nail 34 in the "feed" position as that nail is longitudinally advanced toward the "set" position such as that illustrated in FIG. 8 and to be hereinafter more fully set forth.

Figures 3, 4, 5, 6, 7, 8:
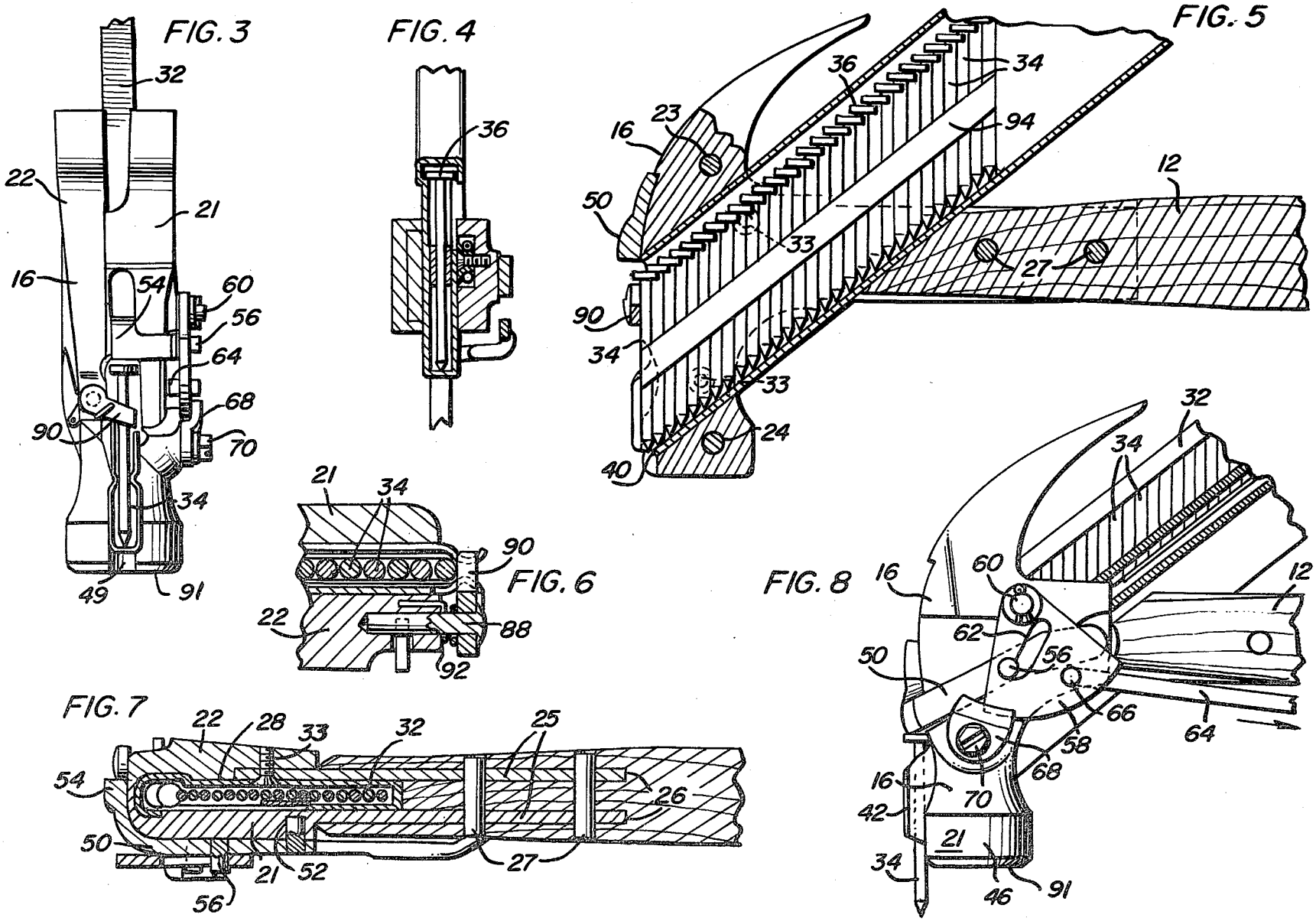
FIG. 3 is an end elevational view of the hammer as seen from the head end thereof.
FIG. 4 is an enlarged fragmentary transverse vertical sectional view taken substantially upon the plane indicated by the section line 4—4 of FIG. 1.
FIG. 5 is a fragmentary longitudinal sectional view of the head end of the hammer taken substantially along the longitudinal center line of the hammer.
FIG. 6 is an enlarged fragmentary sectional view taken substantially upon the plane indicated by the section line 6—6 of FIG. 2.
FIG. 7 is a fragmentary horizontal sectional view taken substantially upon the plane indicated by the section line 7—7 of FIG. 1.
FIG. 8 is a side elevational view of the hammer similar to the left-hand portion of FIG. 1 but with the nail feed and nail head backing structure in the nail feed and head backing position.

A nail feed and nailhead backing lever 50 is pivotally supported from the head half 21 as at 52, see FIG. 7, and includes a laterally directed nailhead engaging head 54 on its free end. The lever 50 includes a laterally outwardly projecting pin 56 and an actuating lever for bell crank 58 is pivotally supported from the head half 21 as at 60 and includes a J-shaped slot 62 formed therein in which the pin 56 is slidably received. One end of the operating rod 64 is pivotally anchored to the bell crank for actuating lever 58 as at 66 and a guide flange 68 is removably secured to the hammerhead half 21 by a fastener 70 and guidingly engages the side of the bell crank 58 remote from the hammerhead half 21.

An operating lever or bell crank 72 is pivotally supported for angular oscillation in the recess 16 by the fastener 20 and the end of the operating rod 64 remote from the bell crank 58 is pivotally anchored to the bell crank 72 as at 74. In addition, the recess 16 includes a stop pin 76 limiting angular displacement of the operating lever 72 toward the open position thereof illustrated in FIG. 1 and toward which the operating lever 72 is yieldingly biased by an expansion spring 78 connected to the bell crank 72 as at 80 and to a handle supported anchor pin 82 at its remote end. In addition, the recess 16 also includes a stop pin 84 which limits angular displacement of the operating lever 72 toward the closed position thereof with the pin 84 fully seated within the notch 86 formed in the bell crank 72.

The hammerhead half 22 additionally includes a pivot pin 88 supported therefrom, see FIG. 6, having a nail feed stop lever 90 pivotally supported therefrom and a butterfly spring 92 extends about the pivot pin 88 and has its opposite ends anchored relative to the hammerhead half 22 and the nail feed stop lever 90. The spring 92 yieldingly biases the nail feed stop lever 90 toward a position extending across the discharge end 40 of the magazine 32 and prevents lateral displacement of the nails 34 outwardly of the discharge end 40 of the magazine 32.

Figure 2:
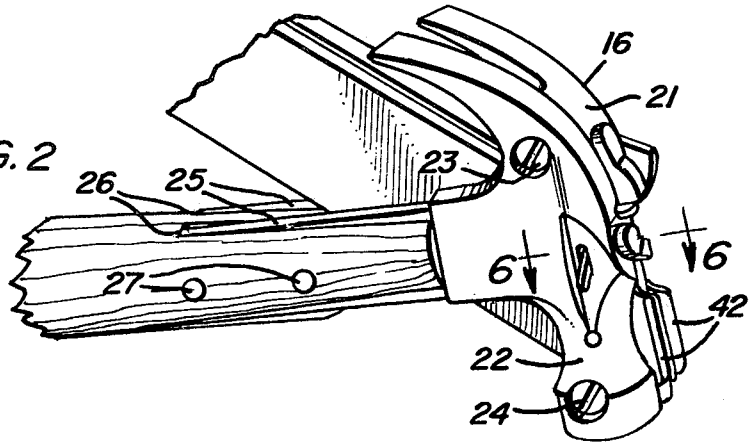
FIG. 2 is a fragmentary perspective view of a major portion of the assemblage illustrated in FIG. 1 as seen from the reverse side thereof.

As the bell crank 72 is swung from the open position thereof illustrated in FIG. 2 of the drawings toward the fully closed position with the pin 84 seated in the notch 86, the rod 64 is displaced rearwardly along the handle 12 toward the handgrip end 14 thereof and the actuating lever 58 is displaced from the position thereof illustrated in FIG. 1 to the position thereof illustrated in FIG. 8. This causes the lever 50 to be pivoted from the inactive position thereof illustrated in FIGS. 1, 3 and 5 toward the nail feed and nailhead backing position thereof illustrated in FIG. 8. During movement of the lever 50 from the position of FIG. 1 to the position of FIG. 8, the endmost nail 34 at the discharge end 40 of the magazine 32 is longitudinally advanced from the nail "feed" position thereof illustrated in FIG. 1 toward the nail "set" position thereof illustrated in FIG. 8 with the tip end of the nail 34 projecting outwardly beyond the impact face 91 of the head 16. Additionally, it will be noted that the pin 56 carried by the lever 50 has moved out of the long leg of the J-shaped slot 62 into the short leg of the J-shaped slot 62 whereby the closed end of the short leg of the J-shaped slot 62 acts to back the pin 56 and thus prevent movement of the lever 50 back toward the position thereof illustrated in FIG. 1. With the nail 34 in the "set" position thereof illustrated in FIG. 8, the hammer 10 may be swung toward a workpiece in order to set the nail 34 in the "set" position in the workpiece. At this point, the nail in the "set" position is held merely between the nail retaining fingers or flanges 42 and is readily stripped from between the flanges 42 as a result of the stroke of the hammer utilized to set the nail 34.

Also, during movement of the lever 50 from the position thereof illustrated in FIG. 1 to the position illustrated in FIG. 2, the lever 50 engages the nail feed stop lever 90 and swings the latter toward an out-of-the-way position thereby enabling the nail 34 at the "feed" position to be readily shifted toward the "set" position.

Thereafter, as the bell crank 72 is allowed to return to the open position thereof illustrated in FIG. 1 of the drawings under the biasing action of the spring 78, the lever 50 returns from the position thereof illustrated in FIG. 8 to the position thereof illustrated in FIG. 1 and the nail feed stop lever 90 is allowed to swing from the out-of-the-way position to the nail feed stopping position thereof illustrated in FIG. 6. As soon as the free end of the lever 50 is displaced upwardly beyond the head of the next nail 34 to be discharged from the discharge end 40 of the magazine 32, the follower 38 shifts the entire load of nails 34 within the magazine 32 toward the discharge end 40 thereof in order to position the next nail 34 in the "feed" position. It will be noted that the nails 34 are disposed within the magazine and connected relative to each other through the utilization of side strips 94 of tape or other means in order that a plurality of nails 34 may be conveniently and quickly placed within the magazine 32 in order to renew the supply of nails therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hammer comprising an elongated handle including an elongated transverse head on one end defining an outwardly facing terminal end impact face on one end portion of said head, elongated generally straight magazine means carried by said hammer and inclined relative to said handle and head, said magazine means, head and handle being disposed in generally the same plan with said magazine means extending through the junction of said head and handle intermediate the opposite sides of said head and handle and with said magazine means including one discharge end opening outwardly of the side of said head remote from said handle, said magazine means slidingly receiving a row of side-by-side longitudinally staggered and transversely extending nails therein for successive lateral movement of said nails longitudinally of said magazine means to a first feed position at said discharge end wherein each nail in the feed position is oriented generally parallel with said head and with its tip end spaced from a plane normal to said nail and containing said impact fact and preparatory to subsequent longitudinal movement of said nail to a set position wherein the nail is oriented with its tip end extending through said plane normal to said nail and containing said impact face, feed means mounted on said hammer for movement between a first position behind and engaged with the head of a nail in the feed position and a second position displaced in the direction in which the feed position nail tip end faces for displacing the feed position nail from the feed position to the set position.

2. The hammer of claim 1 including an operator shiftably supported from said hammer handle for movement between first and second positions, and connecting means operatively connecting said operator and feed means to shift the latter from its first position to its second position responsive to movement of said operator from its first position to its second position.

3. The hammer of claim 2 wherein said connecting means including a bell crank oscillatably supported from said head, said feed means comprising a lever oscillatably supported from said head, and a pin and slot connection operably connecting said bell crank to said lever for oscillation of the latter responsive to oscillation of the former.

4. The hammer of claim 3 wherein said pin and slot connection includes a pin carried by said lever and a slot formed in said bell crank in which said pin is slidably and rotatably received.

5. The hammer of claim 4 wherein said slot includes generally right angulated and communicated long and short leg portions, said pin received in the end of said long leg portion when said feed means is in said first position and said pin is received in the end of said short leg portion remote from said long leg portion when said feed means is in said second position, said short leg portion being disposed generally normal to the direction in which said pin must move during movement of said feed means from said second position to said first position when said feed means is in said second position, thereby establishing a positive lock against movement of said feed means from said second position to said first position when said operator is in said second position.

6. A hammer comprising an elongated handle including an elongated transverse head on one end defining and outwardly facing terminal end impact face on one end portion of said head, said head comprising a pair of laterally opposing head halves having opposing side faces, at least one of said side faces defining an inclined passage extending through said head in a plane containing said head and handle, elongated generally straight tubular magazine means extending through said passage and inclined relative to said handle and head, said magazine means including one discharge end opening outwardly of the side of said head remote from said handle, said magazine means slidably receiving a row of elongated side-by-side longitudinally staggered and transversely extending nails therein with said nails paralleling the longitudinal extent of said head and for successive lateral movement of said nails longitudinally of said magazine means to a first position at said discharge end wherein each nail in the feed position is oriented generally parallel with said head and with its tip end spaced from a plane normal to said nail and containing said impact face and preparatory to subsequent longitudinal movement of said nail to a set position wherein the nail is oriented with its tip end extending through said plane normal to said nail and containing said impact face, each of said head valves including an elongated mounting shank portion extending longitudinally of said handle toward the end thereof remote from said head, said shank portions being laterally spaced apart and receiving a portion of said magazine therebetween, the end of said handle adjacent said head having longitudinally endwise outwardly opening slots formed therein in which said shank portions are snugly received, and transverse fastener means secured through the end of said handle adjacent said head and said mounting shank portions.

7. The hammer of claim 6 wherein said head includes nail retaining means shiftable between first and second positions and operable when in the first position thereof, to guidingly engage a nail in said feed position for straight lengthwise displacement toward said set position against lateral displacement relative to said head, and feed means shiftably supported from said head for movement between first and second positions and operable, upon movement from the first position thereof to the second position thereof to shift a nail in the feed position to the discharge position, said feed means, during movement thereof from said first position to said second position being operative to automatically shift said nail retaining means from the first position to the second position thereof.

8. A hammer comprising an elongated handle including an elongated transverse head on one end defining an outwardly facing terminal end impact face on one end portion of said head, elongated generally straight tubular magazine means carried by said hammer and inclined relative to said handle and head, said magazine means, head and handle being disposed in generally the same plane with said magazine means extending through the junction of said head and handle intermediate the opposite sides of said head and handle and with said magazine means including one discharge end opening outwardly of the side of said head remote from said handle, said magazine means slidingly receiving a row of elongated side-by-side longitudinally staggered and transversely extending nails therein with said nails paralleling the longitudinal extent of said head and for successive lateral movement of said nails longitudinally of said magazine means to a first feed position at said discharge end wherein each nail in the feed position is oriented generally parallel with said head and with its tip end spaced from a plane normal to said nail and containing said impact face and preparatory to subsequent longitudinal movement of said nail to a set position wherein the nail is oriented with its tip end extending through said plane normal to said nail and containing said impact face, feed means mounted on said hammer for movement between a first position behind and engaged with the head of a nail in the feed position and a second position displaced in the direction in which the feed position nail tip end faces for straight lengthwise displacing the feed position nail from the feed position to the set position, said head comprising a pair of laterally opposing opposite side head halves, the opposing sides of said head halves defining a passageway extending therebetween in which said magazine means is received, means removably securing said head together.

9. The hammer of claim 8 wherein each of said head halves includes an integral mounting shank portion extending along and projecting toward the remote end of said handle, said mounting shank portions being laterally spaced apart and the end of said handle adjacent said head including longitudinally extending endwise outwardly opening slots formed therein in which said mounting shank portions are snugly received, and transverse fastener means secured through said handle and said mounting shank portions.

10. The hammer of claim 8 including an operator shiftably supported from said hammer handle for movement between first and second positions, and connecting means operatively connecting said operator and feed means to shift the latter from its first position to its second position responsive to movement of said operator from its first position to its second position.

11. The hammer of claim 10 wherein said connecting means includes a bell crank oscillatably supported from said head, said feed means comprising a lever oscillatably supported from said head, and a pin and slot connection operably connecting said bell crank to said lever for oscillation of the latter responsive to oscillation of the former.

12. The hammer of claim 11 wherein said pin and slot connection includes a pin carried by said lever and a slot formed in said bell crank in which said pin is slidably and rotatably received.

13. The hammer of claim 5 wherein said slot includes generally right angulated and communicated long and short leg portions, said pin received in the end of said long leg portion when said feed means is in said first position and said pin is received in the end of said short leg portion remote from said long leg portion when said feed means is in said second position, said short leg portion being disposed generally normal to the direction in which said pin must move during movement of said feed means from said second position to said first position when said feed means is in said second position, thereby establishing a positive lock against movement of said feed means from said second position to said first position when said operator is in said second position.

14. The hammer of claim 8 wherein said head includes nail retaining means shiftable between first and second positions and operable, when in the first position thereof, to guidingly engage a nail in said feed position for lengthwise displacement toward said set position against lateral displacement relative to said head and operable to allow lateral displacement of said nail relative to the head for disengagement of the nail from the head when the retaining means is in its second position.

* * * * *